US006628075B1

(12) United States Patent
Kim

(10) Patent No.: US 6,628,075 B1
(45) Date of Patent: Sep. 30, 2003

(54) PLASMA DISPLAY PANEL WITH FIRST AND SECOND INNER AND OUTER ELECTRODES

(75) Inventor: Jae Sung Kim, Kyongsangbuk-do (KR)

(73) Assignee: LG Electronics, Inc., Seoul (KR)

( * ) Notice: Subject to any disclaimer, the term of this patent is extended or adjusted under 35 U.S.C. 154(b) by 235 days.

(21) Appl. No.: 09/621,488

(22) Filed: Jul. 21, 2000

(30) Foreign Application Priority Data

Sep. 28, 1999 (KR) ..... 1999-41564

(51) Int. Cl.[7] ..... H01J 17/49

(52) U.S. Cl. ..... 313/586; 313/582; 313/491; 313/583

(58) Field of Search ..... 313/586, 485, 313/491, 492, 583, 584, 587, 590, 582

(56) References Cited

U.S. PATENT DOCUMENTS 5,351,144 A * 9/1994 Tanamachi ..... 359/54
5,952,782 A * 9/1999 Nanto et al. ..... 313/584
6,031,329 A * 2/2000 Nagano ..... 313/582
6,195,073 B1 * 2/2001 Lin ..... 345/67
6,232,717 B1 * 5/2001 Oida et al. ..... 313/586
6,255,779 B1 * 7/2001 Ha et al. ..... 313/582
6,262,532 B1 * 7/2001 Park et al. ..... 313/585
6,266,033 B1 * 7/2001 Kim ..... 345/66
6,420,830 B1 * 7/2002 Youn ..... 313/586

FOREIGN PATENT DOCUMENTS

JP 10-333636 12/1998

* cited by examiner

*Primary Examiner*—Vip Patel
*Assistant Examiner*—Kevin Quarterman
(74) *Attorney, Agent, or Firm*—Fleshner & Kim, LLP

(57) ABSTRACT

A plasma display panel is disclosed, in which the discharge distance is expanded to generate ultraviolet rays in a positive column region and discharge current is reduced to decrease power consumption. The plasma display panel includes a plurality of first outer electrodes successively formed on a substrate at predetermined intervals, a plurality of first inner electrodes formed in parallel to the first outer electrodes and mated with the first outer electrodes one by one, a plurality of second outer electrodes formed in parallel to the first outer electrodes, and a plurality of second inner electrodes formed between the first inner electrodes and the second outer electrodes and mated with the second outer electrodes one by one.

16 Claims, 10 Drawing Sheets

PLASMA DISPLAY PANEL WITH FIRST AND SECOND INNER AND OUTER ELECTRODES

BACKGROUND OF THE INVENTION

1. Field of the Invention

The present invention relates to a plasma display panel which displays picture using gas discharge between glass substrates, and more particularly, to a structure of a discharge electrode for a plasma display panel.

2. Discussion of the Related Art

Generally, a plasma display panel has high definition of a cathode ray tube(CRT), and various sized screens, and a thin thickness such as a liquid crystal display device. In this respect, the plasma display panel has lately attracted considerable attention as the most practical next generation display of flat panel displays. Also, since the plasma display panel has a weight of ⅓ of a CRT having the same sized screen, a large sized panel of 40 inch to 60 inch can thinly be fabricated at a thickness of 10 cm or below.

The CRT and the liquid crystal display device are limited by their sizes when digital data and full motion are displayed at the same time. However, the plasma display panel does not have such a problem. Furthermore, the CRT may be affected by magnetic force but the plasma display panel is not susceptible to magnetic force, thereby providing stable image to viewers. Moreover, since each pixel of the plasma display panel is digitally controlled, image distortion of corners on a screen does not occur. Thus, the plasma display panel can provide higher picture quality than the CRT.

The plasma display panel displays picture using its internal gas discharge. Since active devices are not required for each cell, the fabrication process is simple. Also, a large sized screen and high response speed can be obtained. For these reasons, the plasma display panel is widely used as a picture display device having a large sized screen, particularly a picture display device for high definition televisions, monitors, and indoor and outdoor advertizement.

The plasma display panel includes two glass substrates coated with electrodes, and a gas sealed between the glass substrates. The electrodes formed in the glass substrates oppose each other in vertical direction, and pixels are formed in crossing portions of the electrodes. A voltage of 100V or more is applied across the electrodes to produce glow discharge within minute cells around the electrodes to emit light from each cell, thereby displaying picture information.

Such a plasma display panel is classified into three types, a two-electrode type, a three-electrode type, and a four-electrode type in accordance with the number of electrodes assigned to each cell. Of them, the two-electrode type is intended that an address voltage and a sustain voltage are applied to two electrodes. The three-electrode type is generally called an area discharge type and is intended that a discharge cell is switched or sustained by a voltage applied to an electrode disposed at a side of the discharge cell.

Such a related art plasma display panel of three-electrode area discharge type will be described with reference to the accompanying drawings.

FIG. 1 is an exploded perspective view of upper and lower substrates of a general plasma display panel, and FIG. 2 is a sectional view of a related art plasma display panel.

As shown in FIGS. 1 and 2, the plasma display panel of three-electrode area discharge type includes an upper substrate 10 and a lower substrate 20 which are bonded to each other with a certain space and sealed.

The upper substrate 10 includes scan electrodes 16 and 16', sustain electrodes 17 and 17', a dielectric layer 11, and a protection layer 12. The scan electrodes 16 and 16' are formed in parallel to the sustain electrodes 17 and 17'. The dielectric layer 11 is deposited on the scan electrodes 16 and 16' and the sustain electrodes 17 and 17'.

The lower substrate 20 includes an address electrode 22, a dielectric film 21 formed on an entire surface of the substrate including the address electrode 22, an isolation wall 23 formed on the dielectric film 21 between the address electrodes, and a phosphor 24 formed on surfaces of the isolation wall 23 in each discharge cell and of the dielectric film 21. The upper substrate and the lower substrate 20 are joined together by a frit glass. Inert gases such as He and Xe are mixed in a space between the upper substrate 10 and the lower substrate 20 at a pressure of 400 to 500 Torr. The space is used as a discharge area.

In general, a mixing gas of He—Xe is filled in a discharge area of a DC type plasma display panel. A mixing gas of Ne—Xe is filled in a discharge area of an AC type plasma display panel.

The scan electrodes 16 and 16' and the sustain electrodes 17 and 17' are of transparent electrodes and metals so as to increase optical transmitivity of each discharge cell, as shown in FIGS. 3 and 4. That is to say, the electrodes 16 and 17 are of transparent electrodes while the electrodes 16' and 17' are of metals.

A discharge voltage from an externally provided driving integrated circuit(IC) is applied to the metal scan and sustain electrodes 16' and 17'. The discharge voltage applied to the metal electrodes 16' and 17' is applied to the transparent electrodes 16 and 17 to generate discharge between the adjacent transparent electrodes 16 and 17. The transparent electrodes 16 and 17 have an overall width of about 300 $\mu$m and are made of indium oxide or tin oxide. The metal electrodes 16' and 17' are formed of a three-layered thin film of Cr—Cu—Cr. At this time, the bus electrodes 16' and 17' have a line width of ⅓ of a line width of the transparent electrodes 16 and 17.

FIG. 5 is a wiring diagram of scan electrodes ($S_{m-1}$, $S_m$, $S_{m+1}$, . . . , $S_{n-1}$, $S_n$, $S_{n+1}$) and sustain electrodes ($C_{m-1}$, $C_m$, $C_{m+1}$, . . . , $C_{n-1}$, $C_n$, $C_{n+1}$) arranged on the upper substrate. In FIG. 5, the scan electrodes are insulated from one another while the sustain electrodes are connected in parallel. Particularly, a block indicated by a dotted line in FIG. 5 shows an active area where an image is displayed and the other blocks show inactive areas where an image is not displayed. The scan electrodes arranged in the inactive areas are generally called dummy electrodes 26. The number of the dummy electrodes 26 are not specially limited.

The operation of the aforementioned AC type plasma display panel of three-electrode area discharge type will be described with reference to FIGS. 6*a* to 6*d*.

If a driving voltage is applied between the address electrodes and the scan electrodes, opposite discharge occurs between the address electrodes and the scan electrodes as shown in FIG. 6*a*. The inert gas injected into the discharge cell is instantaneously excited by the opposite discharge. If the inert gas is again transited to the ground state, ions are generated. The generated ions or some electrons of quasi-excited state come into collision with a surface of the protection layer as shown in FIG. 6*b*. The collision of the electrons secondarily discharges electrons from the surface of the protection layer. The secondarily discharged electrons come into collision with a plasma gas to diffuse the discharge. If the opposite discharge between the address electrodes and the scan electrodes ends, wall charges having opposite polarities occur on the surface of the protection layer on the respective address electrodes and the scan electrodes.

If the discharge voltages having opposite polarities are continuously applied to the scan electrodes and the sustain electrodes and at the same time the driving voltage applied to the address electrodes is cut off, area discharge occurs in a discharge area on the surfaces of the dielectric layer and the protection layer due to potential difference between the scan electrodes and the sustain electrodes as shown in FIG. 6*d*. The electrons in the discharge cell come into collision with the inert gas in the discharge cell due to the opposite discharge and the area discharge. As a result, the inert gas in the discharge cell is excited and ultraviolet rays having a wavelength of 147 nm occur in the discharge cell. The ultraviolet rays come into collision with the phosphors surrounding the address electrodes and the isolation wall so that the phosphors are excited. The excited phosphors generate visible light rays, and the visible light rays display an image on a screen.

However, the aforementioned related art plasma display panel has several problems.

Since the distance between the electrodes of the discharge area is short as compared with a general discharge tube display, ultraviolet rays in a positive column region having good emitting efficiency are not generated. In other words, as shown in FIG. 7, since discharge current (2) generated in the transparent electrodes 16 and 17 spaced apart from a field convergence area is remarkably lower than discharge current (1) generated in the transparent electrodes 16 and 17 of the field convergence area, discharge begins in the field convergence area and ends in the end of the transparent electrodes, thereby causing short discharge time. As a result, it is difficult to expand the discharge distance beyond the widths of the transparent electrodes 16 and 17. If the widths of the transparent electrodes 16 and 17 become wide to secure longer discharge distance, discharge capacitance increases proportionally, thereby increasing discharge current. This reduces emitting efficiency and increases power consumption.

Consequently, in the related art plasma display panel, since the discharge distance and the distance time are short, ultraviolet rays in a negative glow region occur but ultraviolet rays in a positive column region do not occur. For this reason, emission efficiency becomes poor, thereby causing poor picture quality.

SUMMARY OF THE INVENTION

Accordingly, the present invention is directed to a plasma display panel that substantially obviates one or more of the problems due to limitations and disadvantages of the related art.

An object of the present invention is to provide a plasma display panel in which the discharge distance is expanded to generate ultraviolet rays in a positive column region and discharge current is reduced to decrease power consumption.

Additional features and advantages of the invention will be set forth in the description which follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages and in accordance with the purpose of the present invention, as embodied and broadly described, a plasma display panel according to the present invention includes first and second outer electrodes formed at both sides of a substrate in a unit pixel region, and first and second inner electrodes formed between the first and second outer electrodes, wherein a first voltage is applied to the first outer electrode and the first inner electrode, and a second voltage is applied to the second outer electrode and the second inner electrode.

In another aspect, a plasma display panel according to the present invention includes a plurality of first outer electrodes successively formed on a substrate at predetermined intervals, a plurality of first inner electrodes formed in parallel to the first outer electrodes and mated with the first outer electrodes one by one, a plurality of second outer electrodes formed in parallel to the first outer electrodes, and a plurality of second inner electrodes formed between the first inner electrodes and the second outer electrodes and mated with the second outer electrodes one by one.

It is to be understood that both the foregoing general description and the following detailed description are exemplary and explanatory and are intended to provide further explanation of the invention as claimed.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENTS

Figure 1:
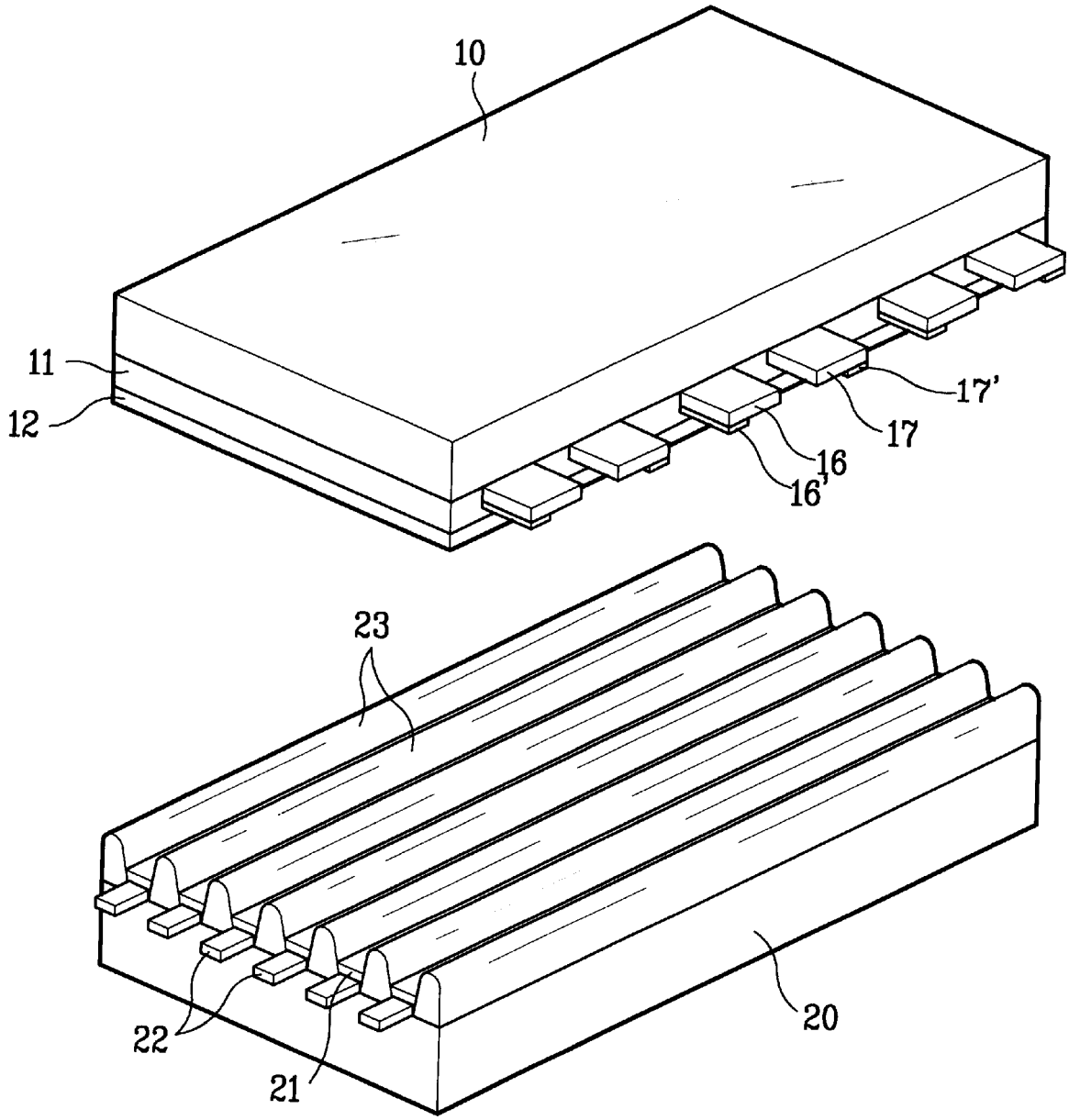
FIG.1 Related Art
FIG. 1 is an exploded perspective view of upper and lower glass substrates of a general plasma display panel.
Figure 2:
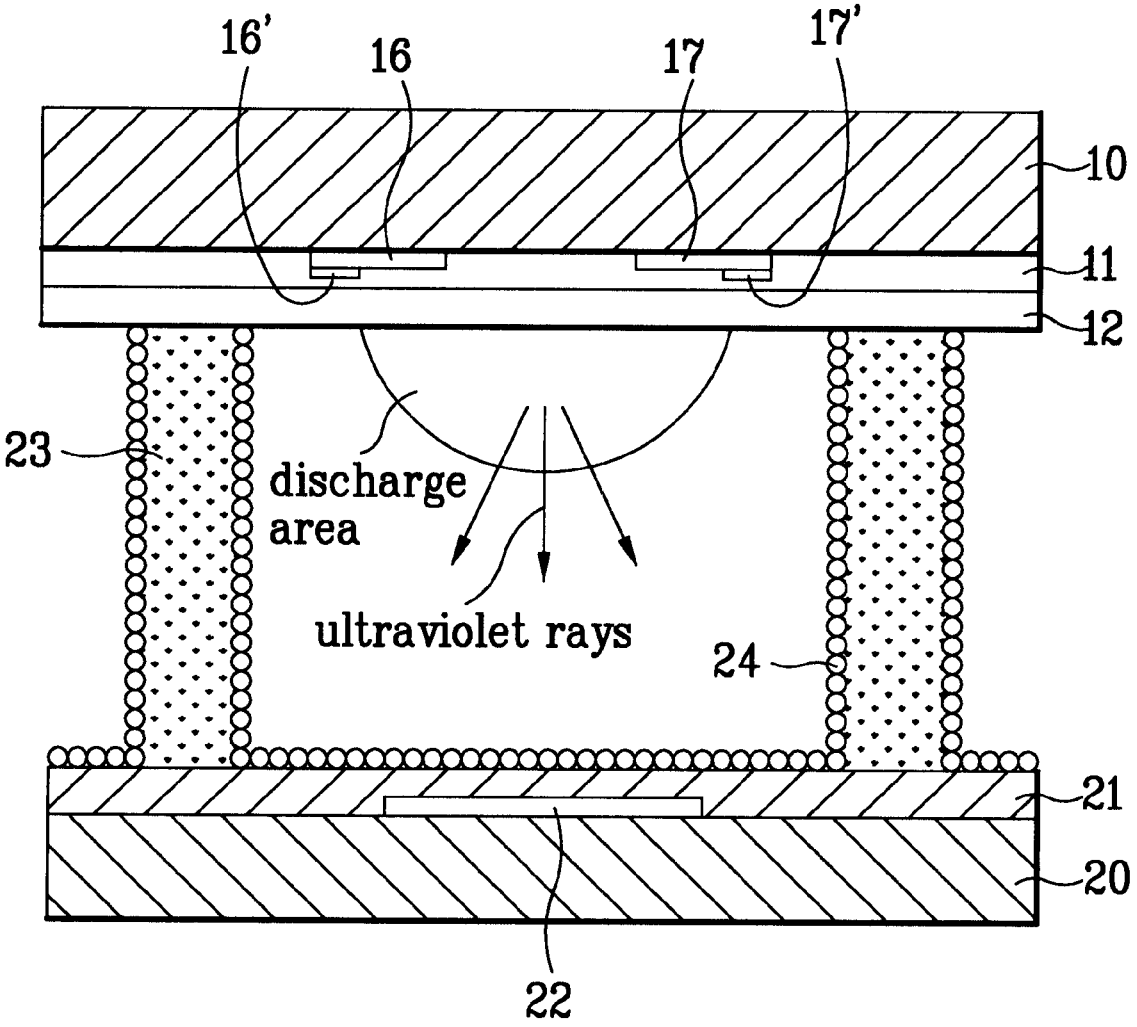
FIG. 2 Related Art
FIG. 2 is a sectional view of a general plasma display panel.
Figure 3:
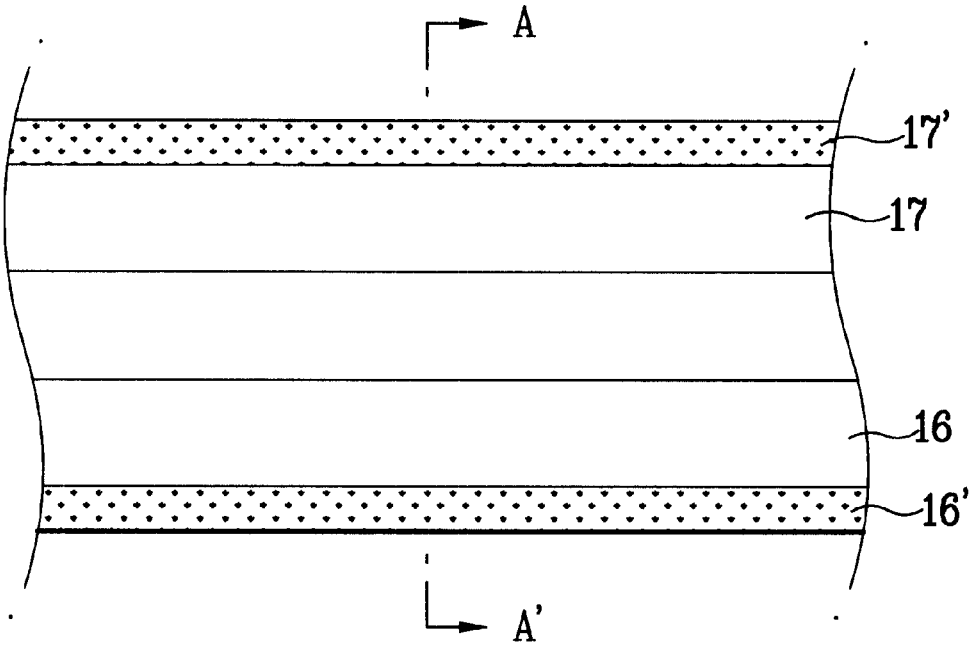
FIG.3 Related Art
FIG. 3 is a structural plane view of a scan electrode and a sustain electrode of a general plasma display panel.
Figure 4:
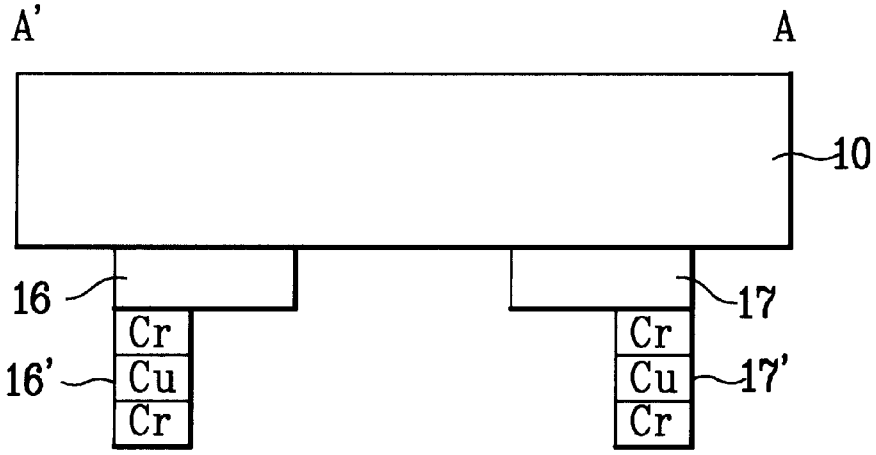
FIG.4 Related Art
FIG. 4 is a structural sectional view of a scan electrode and a sustain electrode of FIG. 3.
Figure 5:
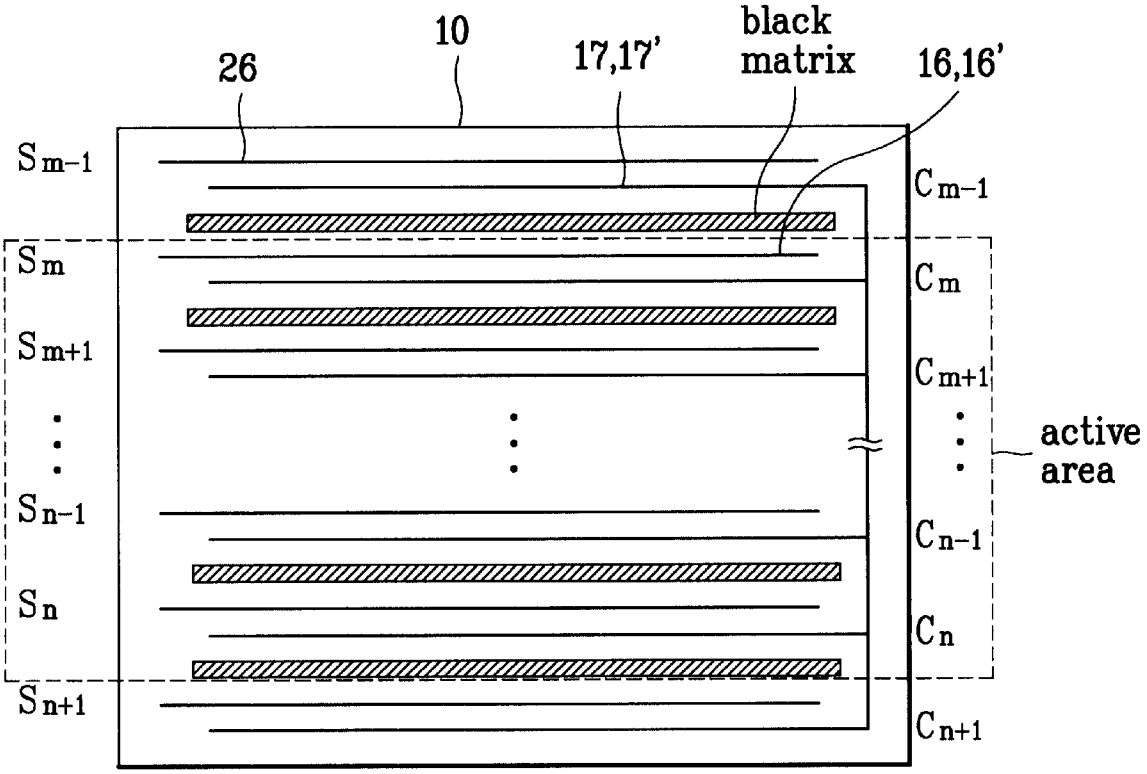
FIG.5 Related Art
FIG. 5 shows wiring of a scan electrode and a sustain electrode of a general plasma display panel.
Figure 6A:
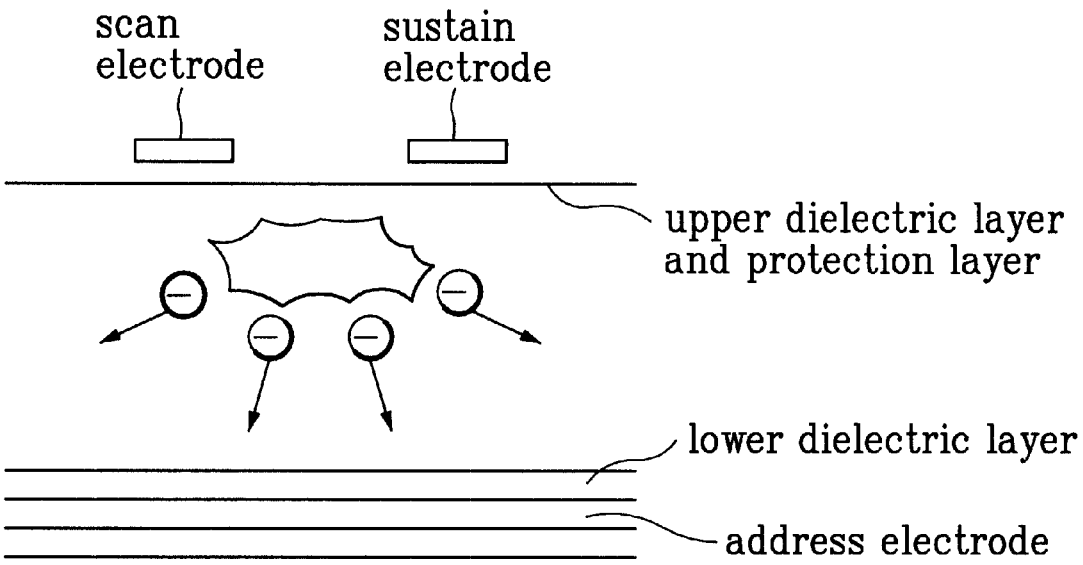
FIG.6A Related Art
FIGS. 6*a* to 6*d* show discharge principles of a general plasma display panel.
Figure 6B:
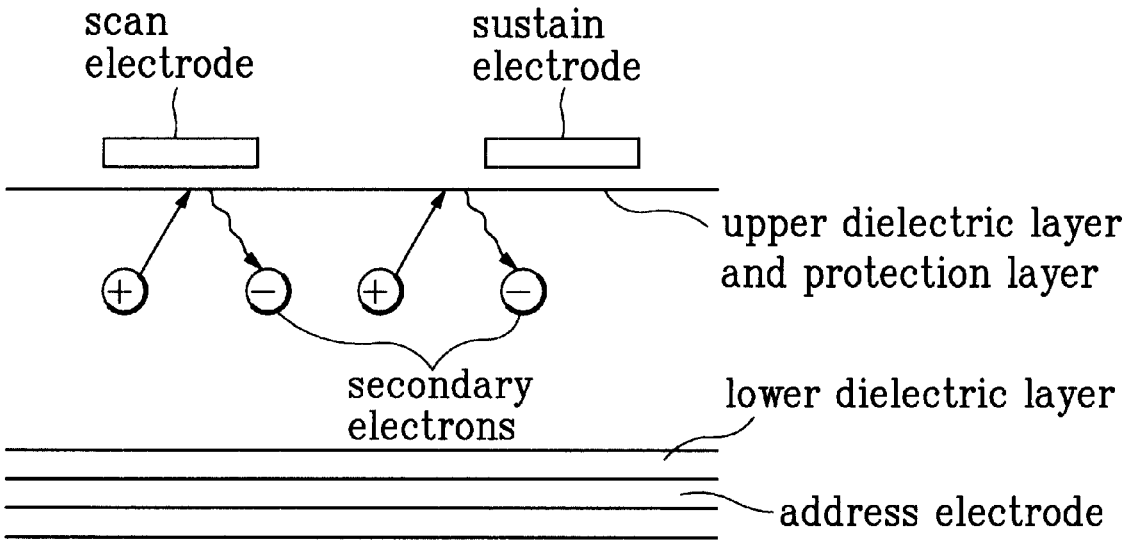
FIG.6B Related Art
Figure 6C:
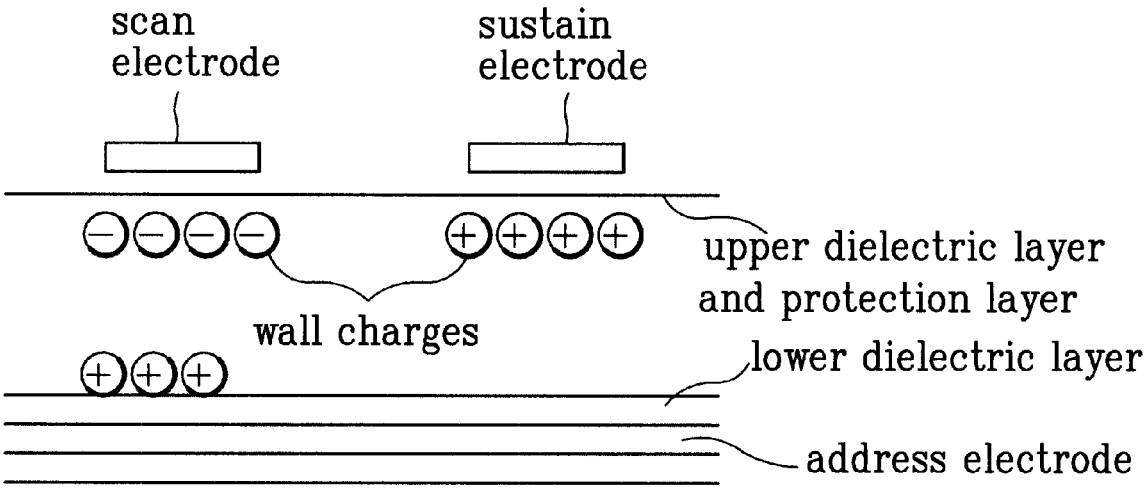
FIG.6C Related Art
Figure 6D:
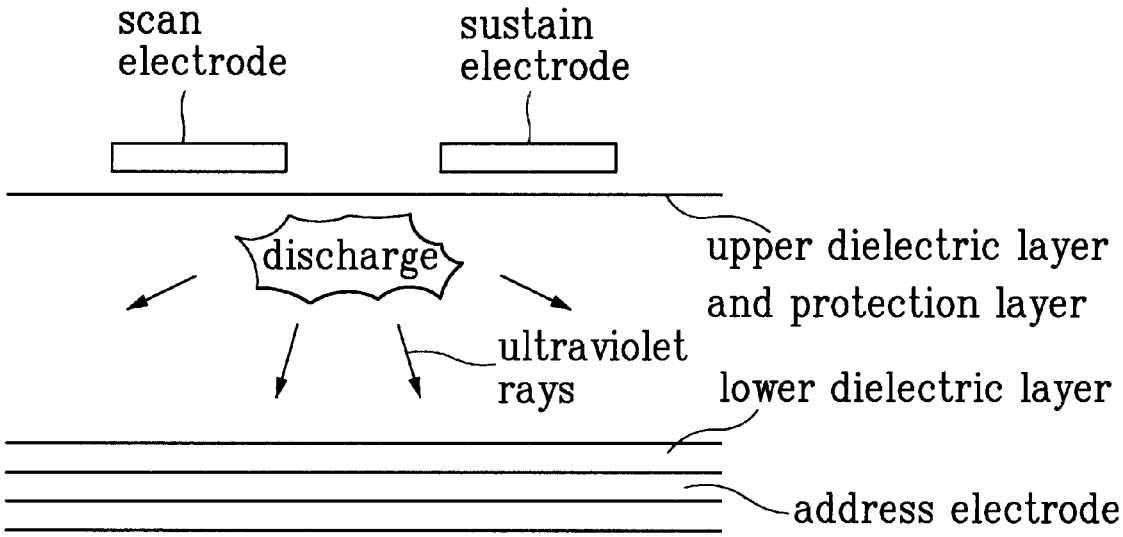
FIG.6D Related Art
Figure 7:
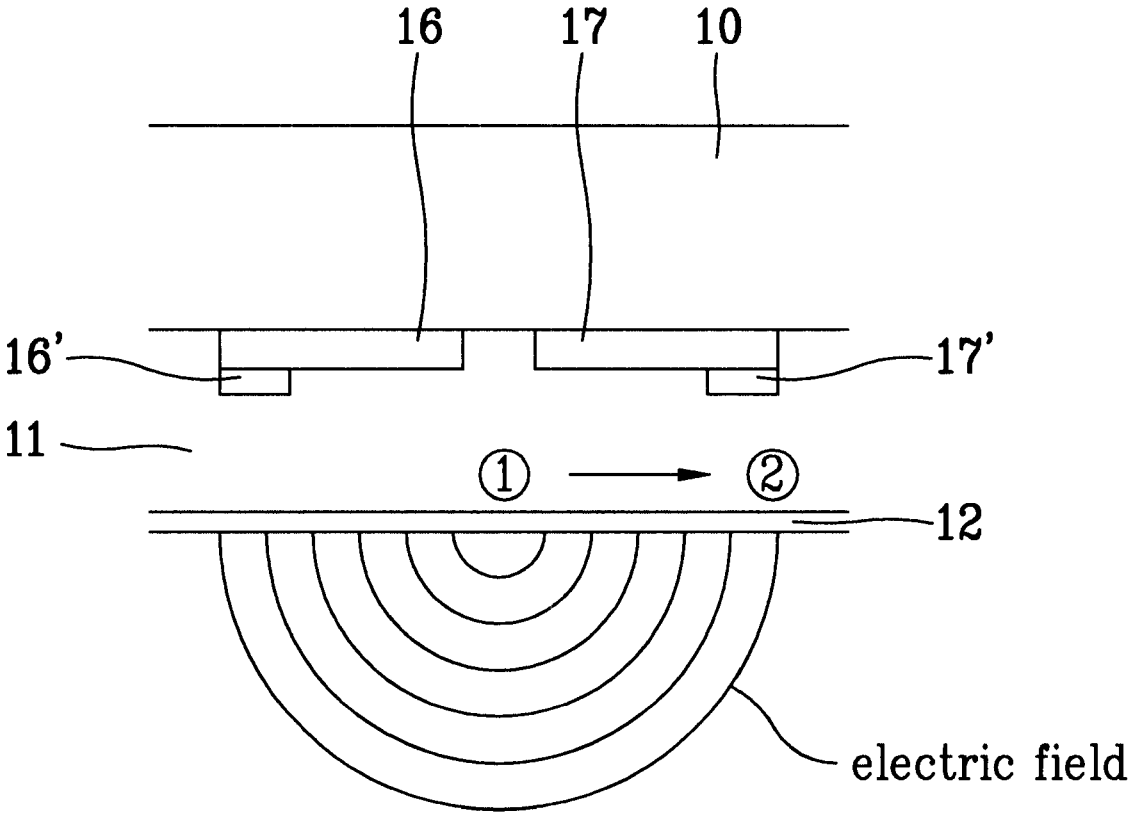
FIG. 7 Related Art
FIG. 7 shows diffusion of electric field and discharge generated between a pair of discharge electrodes of a related art plasma display panel.
Figure 8:
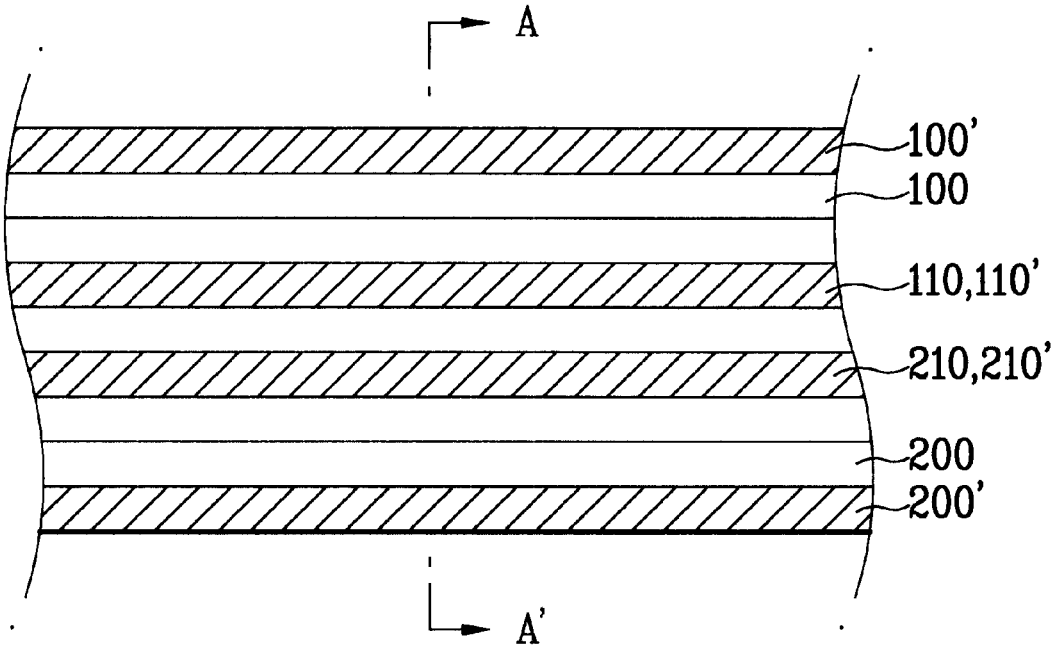
FIG. 8 is a plane view showing electrodes of a plasma display panel according to the first embodiment of the present invention.
Figure 9:
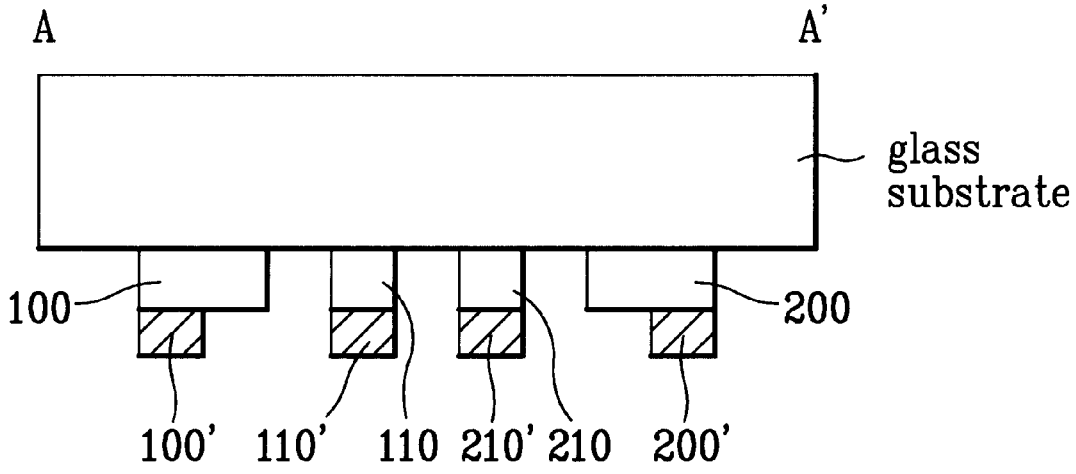
FIG. 9 is a sectional view taken along line II–II' of FIG. 8.

Reference will now be made in detail to the preferred embodiments of the present invention, examples of which are illustrated in the accompanying drawings.

A plasma display panel of the present invention includes a plurality of isolation walls successively formed on a substrate, a plurality of first and second outer electrodes successively formed to be perpendicular to the isolation walls, a plurality of first inner electrodes connected to the first outer electrodes along a non-display region of the substrate and formed in parallel to the first outer electrodes, and a plurality of second inner electrodes connected to the second outer electrodes along the non-display region of the substrate and formed in parallel to the second outer electrodes.

The isolation walls are successively formed on the substrate at predetermined intervals. The isolation walls form a ditch shaped discharge cell. At this time, sub-isolation walls may be formed between the isolation walls to be perpendicular to the isolation walls. Such sub-isolation walls form a lattice-shaped discharge cell.

The plasma display panel of the present invention will be described in detail with reference to the accompanying drawings.

First Embodiment

In a plasma display panel according to the first embodiment of the present invention, first outer electrodes 100 and 100' and second outer electrodes 200 and 200' are formed on an upper glass substrate at both sides of isolation walls. First inner electrodes 110 and 110' and second inner electrodes 120 and 120' are formed between the first and second outer electrodes 100, 100', 200 and 200' at predetermined intervals in parallel to the first and second outer electrodes.

The first and second outer electrodes and the first and second inner electrodes have a layered structure of a transparent electrode and a metal electrode. That is to say, the first and second outer electrodes include transparent electrodes 100 and 200 having a first width, and metal electrodes 100' and 200' having a second width smaller than the first width. Since the metal electrodes 100' and 200' have low resistance, a driving voltage from an external driving circuit is applied to the metal electrodes 100' and 200'. A driving voltage from the metal electrodes 100' and 200' is applied to the transparent electrodes 100 and 200, so that discharge between the transparent electrodes 100 and 200 and an adjacent another transparent electrode occurs. The first and second inner electrodes include transparent electrodes 110 and 210 having a second width smaller than the first width, and metal electrodes 110' and 210' formed with the same width as that of the transparent electrodes 110 and 210 on the transparent electrodes 110 and 210.

Electrodes adjacent to the first outer electrodes 100 and 100' are referred to as the first inner electrodes 110 and 110' while electrodes adjacent to as the second outer electrodes 200 and 200' are referred to as the second inner electrodes 210 and 210'.

Therefore, the first outer electrodes 100 and 100' and the first inner electrodes 110 and 110' serve as sustain electrodes, and the second outer electrodes 200 and 200' and the second inner electrodes 210 and 210' serve as scan electrodes.

If the driving voltage from the external driving circuit is applied to the first outer electrodes 100 and 100' and the first inner electrodes 110 and 110' and the second outer electrodes 200 and 200' and the second inner electrodes 210 and 210', respectively, discharge begins due to the voltage difference between the first outer electrodes 100 and 100' and the second outer electrodes 200 and 200' and/or the voltage difference between the first inner electrodes 110 and 110' and the second inner electrodes 210 and 210'. That is, a first voltage is applied to the first outer electrodes 100 and 100' and the first inner electrodes 110 and 110', and a second voltage is applied to the second outer electrodes 200 and 200' and the second inner electrodes 210 and 210'. In this case, the first voltage and the second voltage may be equal to or different from each other.

Figure 10:
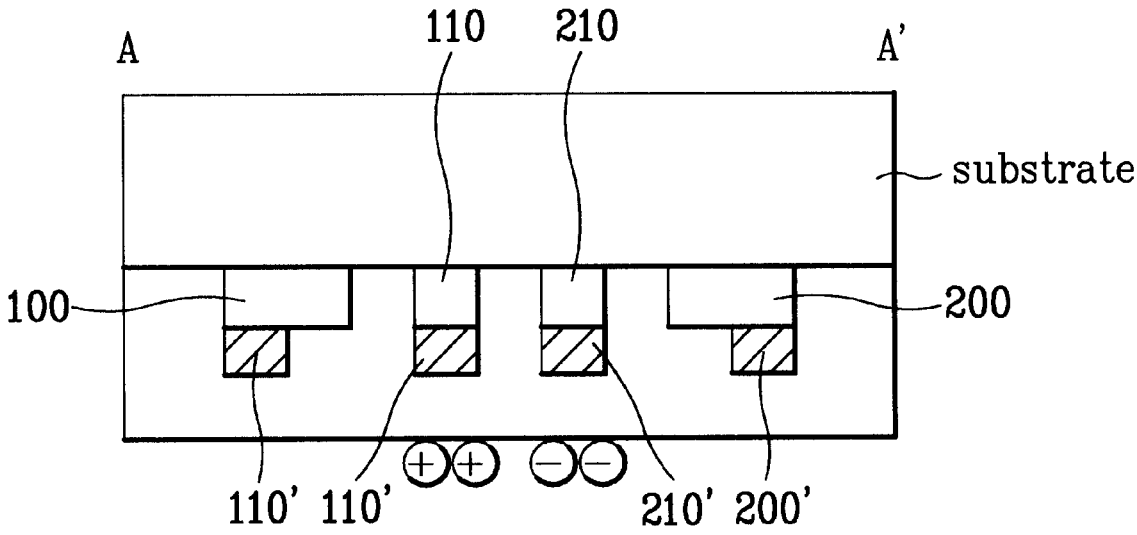
FIG. 10 shows wall charges of FIG. 9.

At this time, plasma discharge occurs in the entire discharge cell of the present invention around the first outer electrodes 100 and 100' and the second outer electrodes 200 and 200'. As shown in FIG. 10, wall charges are converged between the first inner electrodes 110 and 110' and the second inner electrodes 210 and 210', thereby improving luminance at the center of the discharge cell.

Figure 11:
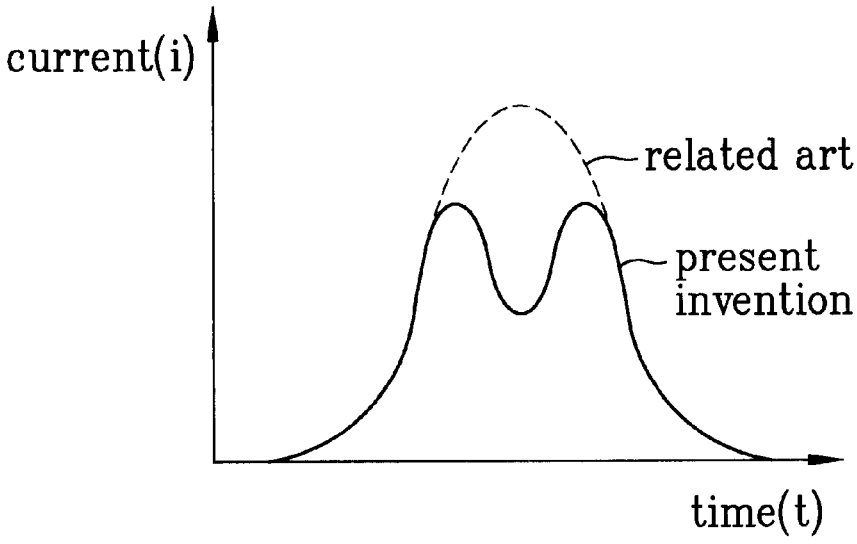
FIG. 11 is a graph showing variation of discharge current in the present invention and the related art.

Accordingly, the wider the distance between the first inner electrodes 110 and 110' and the first outer electrodes 100 and 100' and the distance between the second inner electrodes 210 and 210' and the second outer electrodes 200 and 200' are, the longer the discharge distance is. In other words, in the plasma display panel of the present invention, it is possible to generate ultraviolet rays in a positive column region by controlling the distance between the outer electrodes and the inner electrodes. Also, as shown in FIG. 11, the amount of discharge current becomes small as compared with the related art plasma display panel. This reduces power consumption.

Second Embodiment

Figure 12:
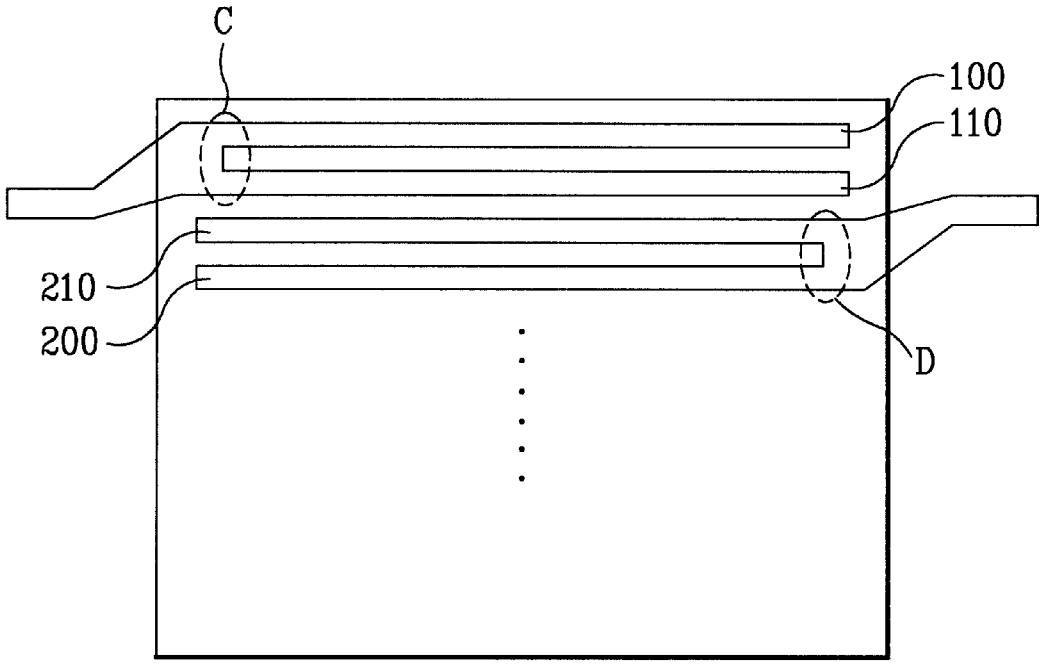
FIG. 12 is a plane view of an electrode of a plasma display panel according to the second embodiment of the present invention.

A plasma display panel according to the second embodiment of the present invention will be described with reference to FIG. 12.

In the plasma display panel according to the second embodiment of the present invention, the first inner electrodes 110 and 110' are connected to the first outer electrodes 100 and 100' at one side C of a non-display region of the substrate. The second inner electrodes 210 and 210' are connected to the second outer electrodes 200 and 200' at one side D of the outline (non-display region) of the substrate.

The operation of the plasma display panel according to the second embodiment of the present invention is identical to that of the plasma display panel according to the first embodiment of the present invention, because the first voltage is applied to the first outer electrode and the first inner electrode, and the second voltage is applied to the second outer electrode and the inner electrode.

Third Embodiment

Figure 13:
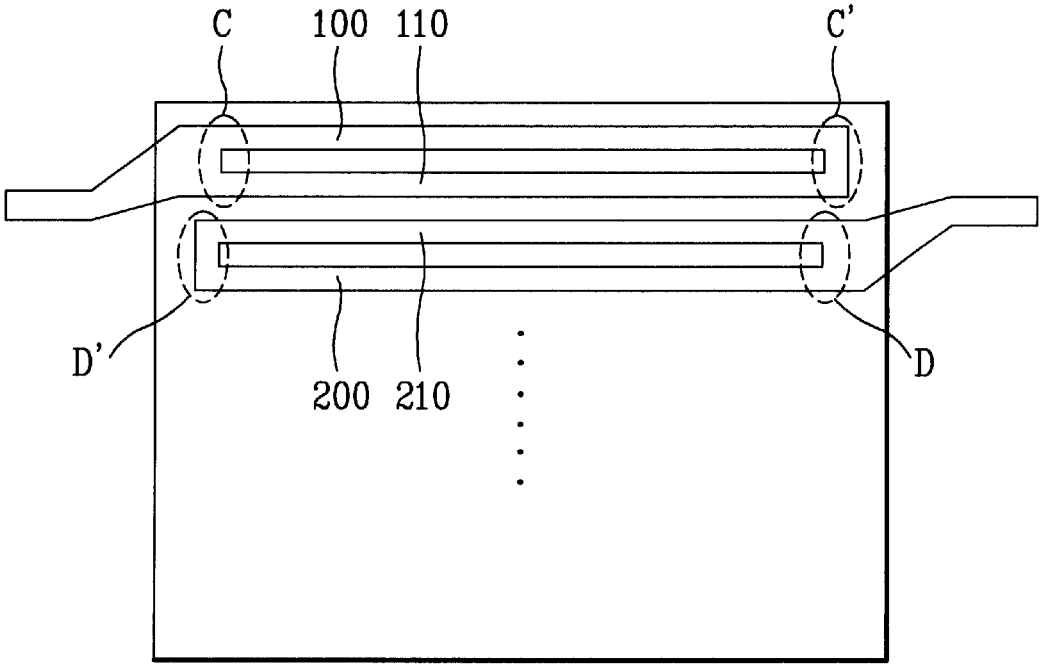
FIG. 13 is a plane view of an electrode of a plasma display panel according to the third embodiment of the present invention.

A plasma display panel according to the third embodiment of the present invention will be described with reference to FIG. 13.

In the plasma display panel according to the third embodiment of the present invention, the first inner electrodes 110 and 110' are connected to the first outer electrodes 100 and 100' at both sides C and C' of the outline(non-display region) of the substrate. The second inner electrodes 120 and 120' are connected to the second outer electrodes 200 and 200' at both sides D and D' of the outline(non-display region) of the substrate.

The operation of the plasma display panel according to the third embodiment of the present invention is identical to that of the plasma display panel according to the first embodiment of the present invention.

In the plasma display panel according to the above embodiments of the present invention, a dielectric layer (not shown) may further be formed on the substrate at a thickness of 25 $\mu$m to cover the first outer electrodes 100 and 100' and the first inner electrodes 110 and 110' and the second outer electrodes 200 and 200' and the second inner electrodes 210 and 210'.

As aforementioned, the plasma display panel of the present invention has the following advantages.

Unlike the related art plasma display panel in which the electrode width is obtained by subtracting the distance between the respective discharge electrodes from the discharge distance, the electrode width is obtained by further subtracting the distance between the outer electrodes and the inner electrodes as well as the distance between the respective discharge electrodes from the discharge distance. Accordingly, the electrode width becomes smaller as compared with the related art. Consequently, in a state that the discharge distance is not reduced, the electrode width becomes small. This reduces power consumption and improves discharge efficiency.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel, comprising:

first and second outer electrodes formed on a substrate in a unit pixel region; and first and second inner electrodes formed between the first and second outer electrodes in the unit pixel region on the substrate, wherein a first voltage is applied to the first outer electrode and the first inner electrode, and a second voltage is applied to the second outer electrode and the second inner electrode, and wherein the first inner electrodes and the first outer electrodes are connected to each other at their one side in a non-display region, and the second inner electrodes and the second outer electrodes are connected to each other at their one side in a non-display region.

2. The plasma display panel as claimed in claim 1, wherein the first inner electrodes have smaller widths than those of the first outer electrodes.

3. The plasma display panel as claimed in claim 1, wherein the second inner electrodes have a smaller width than that of the second outer electrodes.

4. The plasma display panel as claimed in claim 1, further comprising a dielectric layer formed on the substrate at a thickness of 25 $\mu$m or more to cover the first and second outer electrodes and the first and second inner electrodes.

5. The plasma display panel as claimed in claim 1, wherein the first outer electrodes have the same width as that of the second outer electrodes.

6. The plasma display panel as claimed in claim 1, wherein the first and second outer electrodes and the first and second inner electrodes respectively have a layered structure of a transparent electrode and a metal electrode, and the transparent electrode of the first and second outer electrodes have a first width and the transparent electrode of the first and second inner electrodes have a second width smaller than the first width.

7. The plasma display panel as claimed in claim 1, wherein the first outer electrode and the first inner electrode are sustain electrodes, and the second outer electrode and the outer inner electrode are scan electrodes.

8. A plasma display panel, comprising:

a plurality of first outer electrodes successively formed on a substrate at predetermined intervals;

a plurality of first inner electrodes formed in parallel to the first outer electrodes and mated with the first outer electrodes one by one;

a plurality of second outer electrodes formed in parallel to the first outer electrodes; and a plurality of second inner electrodes formed between the first inner electrodes and the second outer electrodes and mated with the second outer electrodes one by one, wherein a unit pixel region contains one each of the plurality of first outer, first inner, second outer, and second inner electrodes, wherein the first outer electrode and the first inner electrode are connected to each other at one side in an outline of a display region, and wherein the second outer electrode and the second inner electrode are connected to each other at one side in an outline of a display region.

9. The plasma display panel as claimed in claim 8, further comprising an isolation wall formed to form a lattice-shaped discharge cell which respectively includes portions of the first inner electrode, the second inner electrode, the first outer electrode and the second outer electrode.

10. The plasma display panel as claimed in claim 8, wherein the first inner electrode has a width smaller than the first outer electrode.

11. The plasma display panel as claimed in claim 8, wherein the second inner electrode has a width smaller than the second outer electrode.

12. The plasma display panel as claimed in claim 8, further comprising a dielectric layer formed on the substrate at a thickness of 25 $\mu$m to cover the first and second outer electrodes and the first and second inner electrodes.

13. The plasma display panel as claimed in claim 8, wherein the first and second outer electrodes and the first and second inner electrodes respectively have a layered structure of a transparent electrode and a metal electrode, and the transparent electrode of the first and second outer electrodes have a first width and the transparent electrode of the first and second inner electrodes have a second width smaller than the first width.

14. The plasma display panel as claimed in claim 8, wherein the first outer electrode and the first inner electrode are sustain electrodes, and the second outer electrode and the outer inner electrode are scan electrodes.

15. A plasma display panel, comprising:

an upper substrate;

a lower substrate disposed adjacent to the upper substrate;

two or more isolation walls formed between the upper and lower substrates to define a unit pixel region;

first and second outer electrodes formed on the upper substrate in the unit pixel region; and first and second inner electrodes formed between the first and second outer electrodes in the unit pixel region on the upper substrate, wherein a first voltage is applied to the first outer electrode and the first inner electrode, and a second voltage is applied to the second outer electrode and the second inner electrode, and wherein the first inner electrodes and the first outer electrodes are connected to each other at one side in a non-display region, and the second inner electrodes and the second outer electrodes are connected to each other at one side in a non-display region.

16. The plasma display panel as claimed in claim 15, wherein the first inner electrodes each have a smaller width than a width of the first outer electrodes, and the second inner electrodes each have a smaller width than a width of the second outer electrodes.

* * * * *